US011931628B2

(12) United States Patent
Saito

(10) Patent No.: US 11,931,628 B2
(45) Date of Patent: Mar. 19, 2024

(54) GOLF CLUB HEAD

(71) Applicant: HONMA HOLDINGS GROUP LIMITED, Hong Kong (CN)

(72) Inventor: Daisuke Saito, Sakata (JP)

(73) Assignee: HONMA HOLDINGS GROUP LIMITED (CN)

( * ) Notice: Subject to any disclaimer, the term of this patent is extended or adjusted under 35 U.S.C. 154(b) by 0 days.

(21) Appl. No.: 17/861,501

(22) Filed: Jul. 11, 2022

(65) Prior Publication Data

US 2023/0181977 A1 Jun. 15, 2023

(30) Foreign Application Priority Data

Dec. 10, 2021 (JP) ..... 2021-200497

(51) Int. Cl.
*A63B 53/04* (2015.01)
*A63B 53/08* (2015.01)

(52) U.S. Cl.
CPC ..... *A63B 53/0433* (2020.08); *A63B 53/0408* (2020.08); *A63B 53/0466* (2013.01);
(Continued)

(58) Field of Classification Search
CPC ..... A63B 53/0433; A63B 53/0437; A63B 53/0466
(Continued)

(56) References Cited

U.S. PATENT DOCUMENTS 6,102,813 A * 8/2000 Dill ..... A63B 53/0466 473/335
7,435,190 B2 * 10/2008 Sugimoto ..... A63B 53/0466 473/345
(Continued)

FOREIGN PATENT DOCUMENTS

CN 100528268 C * 8/2009 ..... A63B 53/0466
DE 102007059339 A1 * 1/2009 ..... A63B 53/04
(Continued)

OTHER PUBLICATIONS

Notice of Reasons for Rejection issued in corresponding Japanese Patent Application No. 2021-200497 dated Feb. 22, 2023, with English translation (14 Pages).
(Continued)

*Primary Examiner* — Alvin A Hunter
(74) *Attorney, Agent, or Firm* — Harness, Dickey & Pierce, P.L.C.

(57) ABSTRACT

A golf club head is formed by joining various parts to a head shell made of metal and having a hollow structure. The head shell has a region where a face and a sole are continuous with each other, thereby forming a leading edge between the face and the sole. The sole of the head shell is provided with a concave slot along the leading edge. The slot is configured to bend in a target direction upon hitting a ball with the face. A reinforcing member made of fiber reinforced plastic configured to apply a resistance to bending of the slot is attached in the slot. The slot has a thickness of, for example, about 0.8 mm to 1.3 mm and has a cross-sectional shape forming a parabola. The reinforcing member has a thickness of, for example, about 10% to 20% of the width of the slot in the target direction.

14 Claims, 8 Drawing Sheets

(52) U.S. Cl.
CPC ..... *A63B 2053/0491* (2013.01); *A63B 53/08* (2013.01); *A63B 2209/02* (2013.01)

(58) Field of Classification Search
USPC ..... 473/324–350
See application file for complete search history.

(56) References Cited

U.S. PATENT DOCUMENTS 7,470,201 B2 12/2008 Nakahara et al.
7,582,024 B2 * 9/2009 Shear ..... A63B 60/52 473/332
8,870,679 B2 * 10/2014 Oldknow ..... A63B 53/0466 473/335
9,216,324 B2 * 12/2015 Shear ..... A63B 53/0466
9,403,070 B2 * 8/2016 Stokke ..... A63B 53/04
9,925,428 B2 * 3/2018 Akiyama ..... A63B 53/04
10,343,032 B2 * 7/2019 Martens ..... A63B 60/02
10,343,033 B2 * 7/2019 Frame ..... A63B 60/54
11,266,886 B2 * 3/2022 Stokke ..... A63B 60/00
2005/0026721 A1 2/2005 Imamoto et al.
2005/0119070 A1 * 6/2005 Kumamoto ..... A63B 53/0466 473/345
2006/0052177 A1 * 3/2006 Nakahara ..... A63B 53/0466 473/345
2006/0058114 A1 * 3/2006 Evans ..... A63B 60/00 473/345
2007/0049416 A1 * 3/2007 Shear ..... A63B 53/0466 473/349
2007/0049417 A1 * 3/2007 Shear ..... A63B 53/0466 473/349
2008/0293512 A1 * 11/2008 Chen ..... A63B 53/0466 473/332
2009/0042667 A1 * 2/2009 Lin ..... A63B 53/0466 473/345
2010/0041490 A1 * 2/2010 Boyd ..... A63B 53/0466 473/290
2010/0041494 A1 * 2/2010 Boyd ..... A63B 60/00 473/342
2012/0196701 A1 * 8/2012 Stites ..... A63B 53/06 473/324
2013/0178306 A1 * 7/2013 Beno ..... A63B 60/52 473/307
2014/0080624 A1 * 3/2014 Galvan ..... A63B 53/0466 473/329
2014/0080634 A1 * 3/2014 Golden ..... A63B 53/0466 473/345
2015/0094163 A1 * 4/2015 Motokawa ..... A63B 53/06 473/329
2015/0174461 A1 6/2015 Bennett et al.
2016/0158609 A1 * 6/2016 Takagi ..... A63B 60/50 473/345
2016/0346632 A1 12/2016 Akiyama
2017/0014690 A1 * 1/2017 Morin ..... A63B 60/52

FOREIGN PATENT DOCUMENTS

JP H10-155943 A 6/1998
JP 2005-137940 A 6/2005

OTHER PUBLICATIONS

Extended European Search Report for corresponding Application No. 22181801.6 dated Dec. 7, 2022 (9 Pages).

* cited by examiner

GOLF CLUB HEAD

CROSS REFERENCE TO RELATED APPLICATION

The present application is based on Japanese Priority Document P2021-200497 filed on Dec. 10, 2021. The entire disclosure of the above application is expressly incorporated by reference herein.

BACKGROUND

Technical Field

The present disclosure relates to a golf club head.

Related Art

Regardless of the skill level, increasing the flight distance is an endless challenge for golfers. In particular, differently from the other golf clubs, the improvement in the flight distance performance of the drivers always continues to be expected.

Various factors are involved in the improvement of the flight distance performance. One of the typical factors is the restitution performance of a golf club head. The restitution performance is closely related to the flight distance performance. In order to achieve a higher flight distance performance, attempts have been made so far to enhance the coefficient of restitution of a face that hits a ball.

Often employed for enhancing the coefficient of restitution of a face is a technique that reduces the thickness of the peripheral portion of a face (e.g., see paragraphs [0004], [0009], etc. of Japanese Unexamined Patent Application Publication No. 10-155943 (hereinafter referred to as "Okada et al.")). The trampoline effect occurs on the face by reducing the thickness of the peripheral portion of the face so that the coefficient of restitution to a ball is enhanced.

On the other hand, since the strength is reduced in the thinned region provided to the face, it is not possible to reduce the thickness without limit. Therefore, in view of distributing the stress that is locally applied, attempts have been made to uniformly reduce the thickness of the entire face or to make the face partially thin. However, in terms of reducing the strength of the face, there is no difference from the technique of reducing the thickness of the face described in Okada et al.

Japanese Unexamined Patent Application Publication No. 2005-137940 (hereinafter referred to as "Nakahara et al.") introduces a configuration example to enhance the coefficient of restitution without changing the thickness of a face. This is a technique to use fiber reinforced plastic or the like in at least two of a crown, a heel, a sole, and a toe of a golf club head. More specifically, a cut-out portion is provided in each of regions of the crown and the sole along the edges of the face or in each of regions of the heel and the toe along the edges of the face, and these cut-out portions are each closed by a closing member made of the fiber reinforced plastic or the like (see paragraph [0018] of Nakahara et al.). For the former regions, see paragraphs [0016] and [0017] in the specification and FIG. 1 (a) to (c) of Nakahara et al. For the latter regions, see paragraph [0022] in the specification and FIG. 3 (a) and (b) of Nakahara et al.

Nakahara et al. describes that "the flexural rigidity in the portion provided with the fiber reinforced plastic or the like can be made lower than the flexural rigidity in the face and this makes it possible to increase the deformation of the face upon impact of a golf ball so that it is possible to enhance the coefficient of restitution to the golf ball launched and thus to increase the flight distance of the golf ball" (see paragraph [0009] of Nakahara et al.).

When the structure described in Nakahara et al. is put into practice, since the cut-out portion is a hole passing through a thick wall portion of the golf club head, it is necessary to completely close the cut-out portion with the closing member made of the fiber reinforced plastic or the like. Further, due to the need to hide the presence of the closing member from the outside, the closing member should be joined to the outer surface of the golf club head without a level difference or a seam and finished with painting. The manufacture is complicated.

In addition, the durability is also required so that even when a shock upon hitting a ball is transmitted, no cracks occur in the painting between the golf club head and the closing member, and therefore, the degree of difficulty of the manufacture becomes high.

For a golf club head that is able to enhance the coefficient of restitution with durability, it is a task to facilitate the manufacture.

SUMMARY OF THE INVENTION

One aspect of a golf club head includes a head shell made of metal, a face provided to the head shell, a sole provided to the head shell so as to be continuous with the face through a leading edge, a concave slot provided to the sole along the leading edge and configured to bend in a target direction upon hitting a ball with the face, and a reinforcing member made of fiber reinforced plastic and bonded in the slot, the reinforcing member configured to apply a resistance to bending of the slot.

DETAILED DESCRIPTION OF THE PREFERRED EMBODIMENTS

An embodiment will be described with reference to the drawings. This embodiment is an example of application to a golf club head 11 (hereinafter may also be referred to simply as a "club head 11") having a hollow structure and made of metal. A description will be given along the items listed below.

1. Configuration
   (1) Basic Structure
   (2) Slot and Reinforcing Member
2. Actions
   (1) Improvement in Restitution Performance
   (2) Compliance with SLE Rule
   (3) Improvement in Strength of Slot
   (4) Shock Damping Action
   (5) Club Performance Adjustment Function
   (6) Fixing Strength of Reinforcing Member
3. Modifications 1. Configuration (1) Basic Structure As illustrated in FIGS. 1 to 5, the club head 11 is formed mainly by a head shell 21 having a hollow structure. The head shell 21 is provided on its side with a face 31 serving as a ball hitting surface for a ball (not illustrated) and provided at its upper surface end with a hosel 41 serving as a connecting portion with a shaft (not illustrated). When a player grips the shaft inserted and fixed to the hosel 41, the face 31 is located on the left side of the head shell 21 as viewed from the player and is disposed at approximately a right angle to a target direction TD (see FIGS. 1 and 2). The angle between the target direction TD and the face 31 is determined by a face angle set.

A material of the head shell 21 can be selected from various metals. Among them, it is preferable to use a titanium alloy, an aluminum alloy, a magnesium alloy, or the like with a high specific strength.

Figure 1:
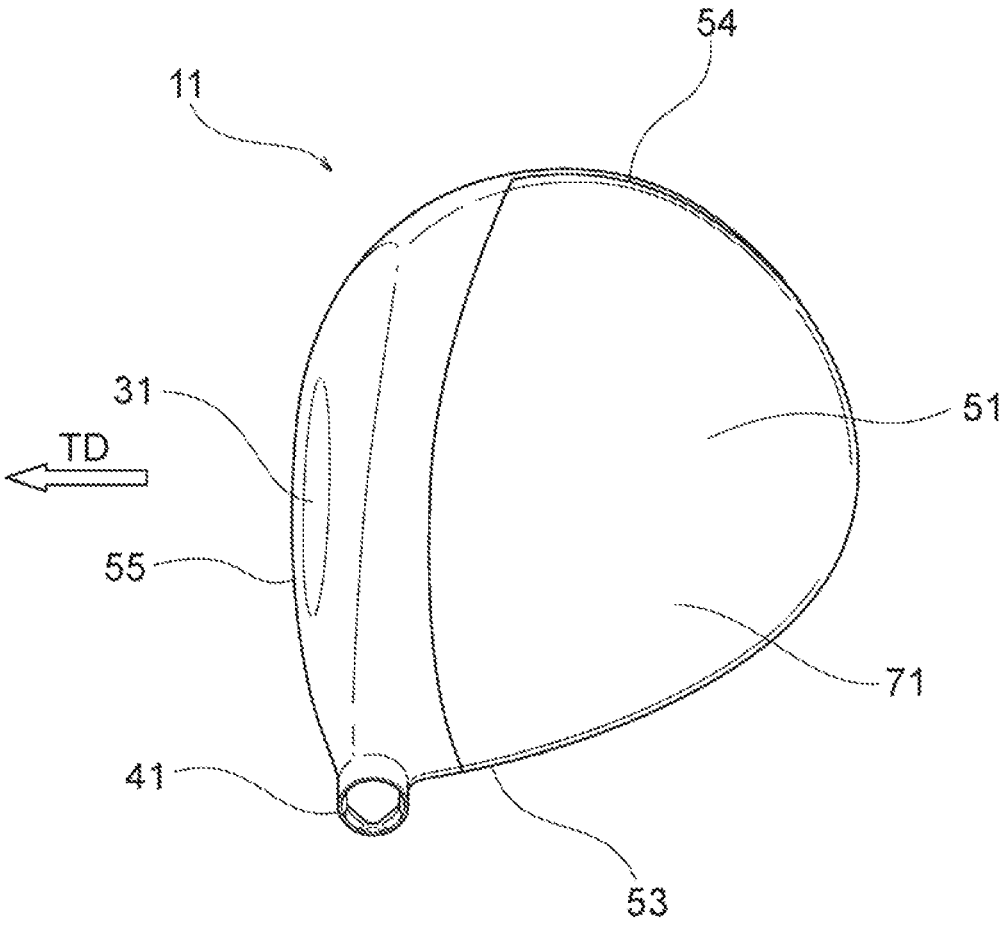
FIG. 1 is a perspective view of a golf club head as viewed from the crown side, illustrating one embodiment.
Figure 2:
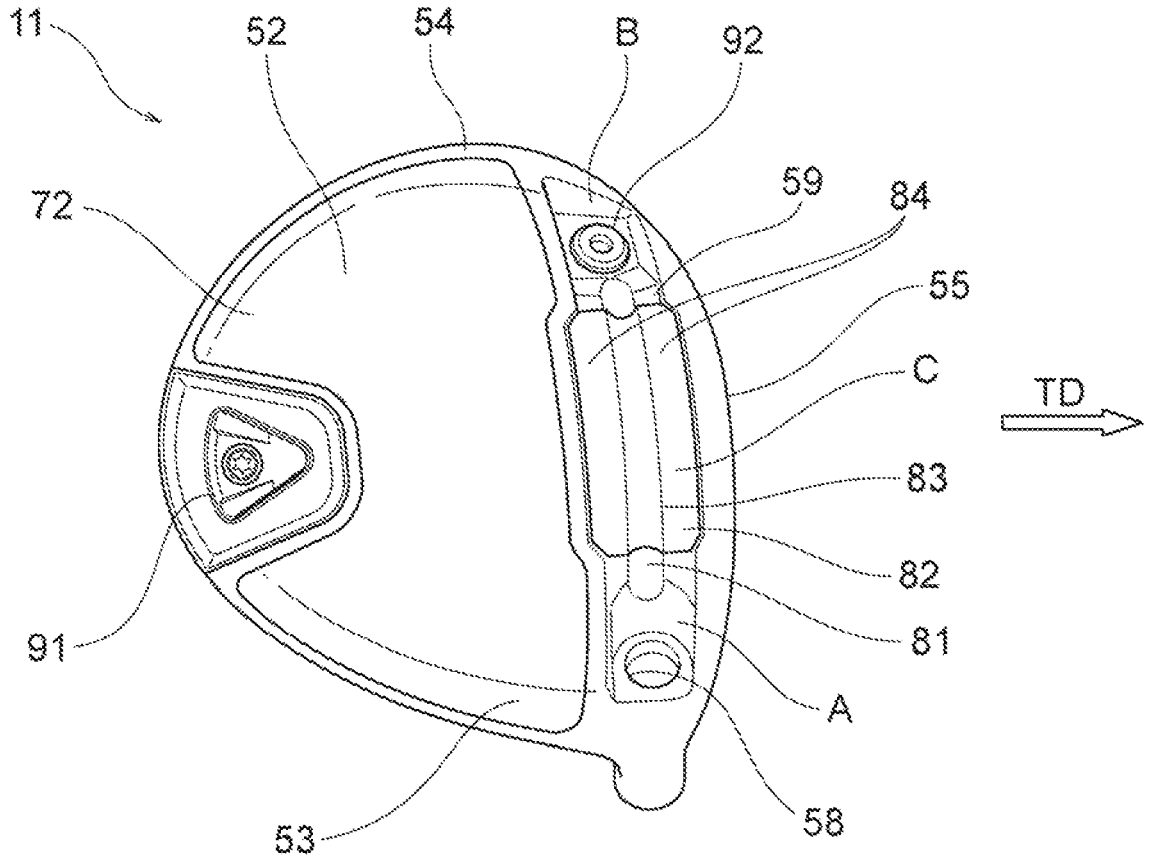
FIG. 2 is a perspective view of the golf club head as viewed from the sole side.

A crown 51 that is seen in front as viewed from the player holding a golf club is provided with a crown member 71 (see FIG. 1), and a sole 52 on the back side of the crown 51 is provided with a sole member 72 (see FIG. 2). The crown member 71 and the sole member 72 are provided from a heel 53 to a toe 54.

Figure 3:
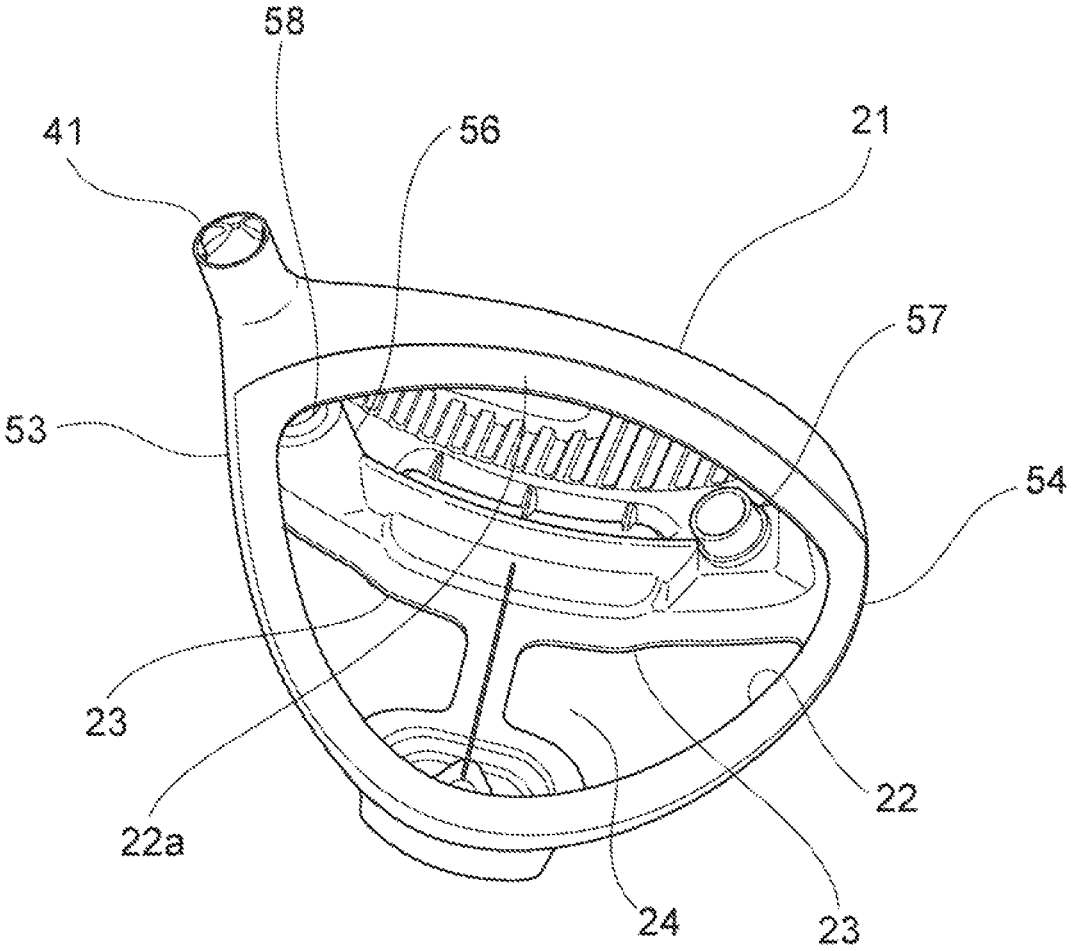
FIG. 3 is a perspective view of a shell member as viewed from the crown side.
Figure 4:
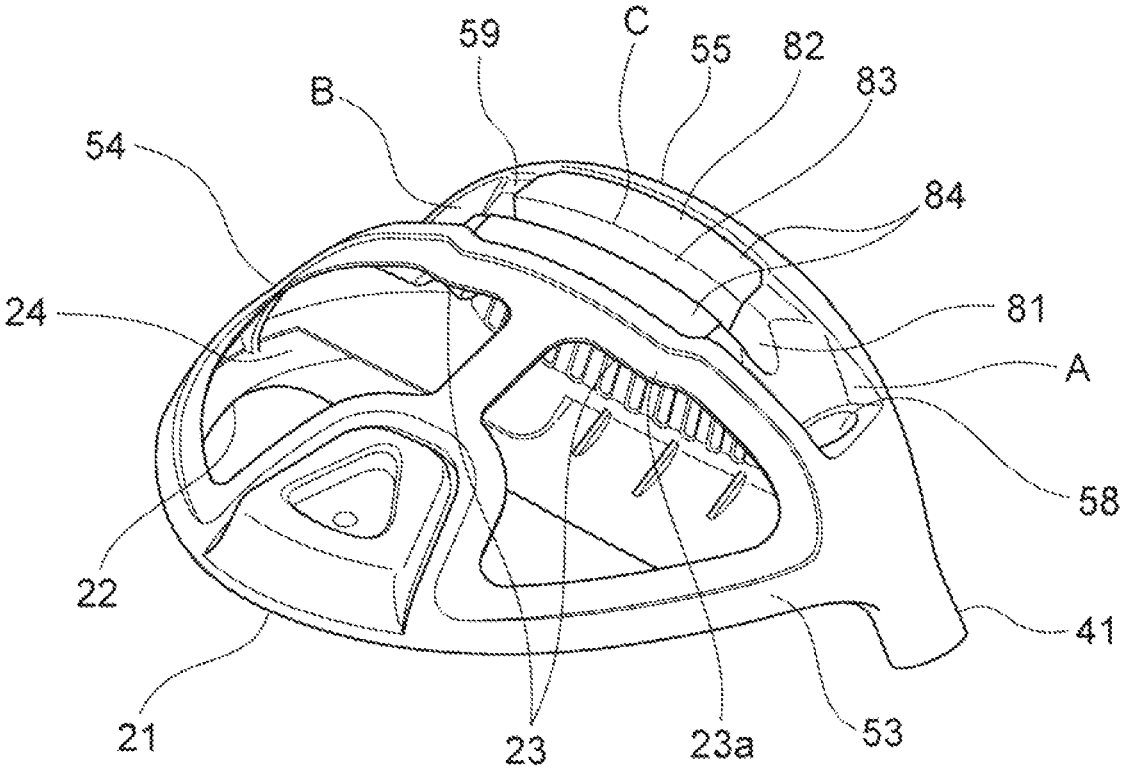
FIG. 4 is a perspective view of the shell member as viewed from the sole side.
Figure 5:
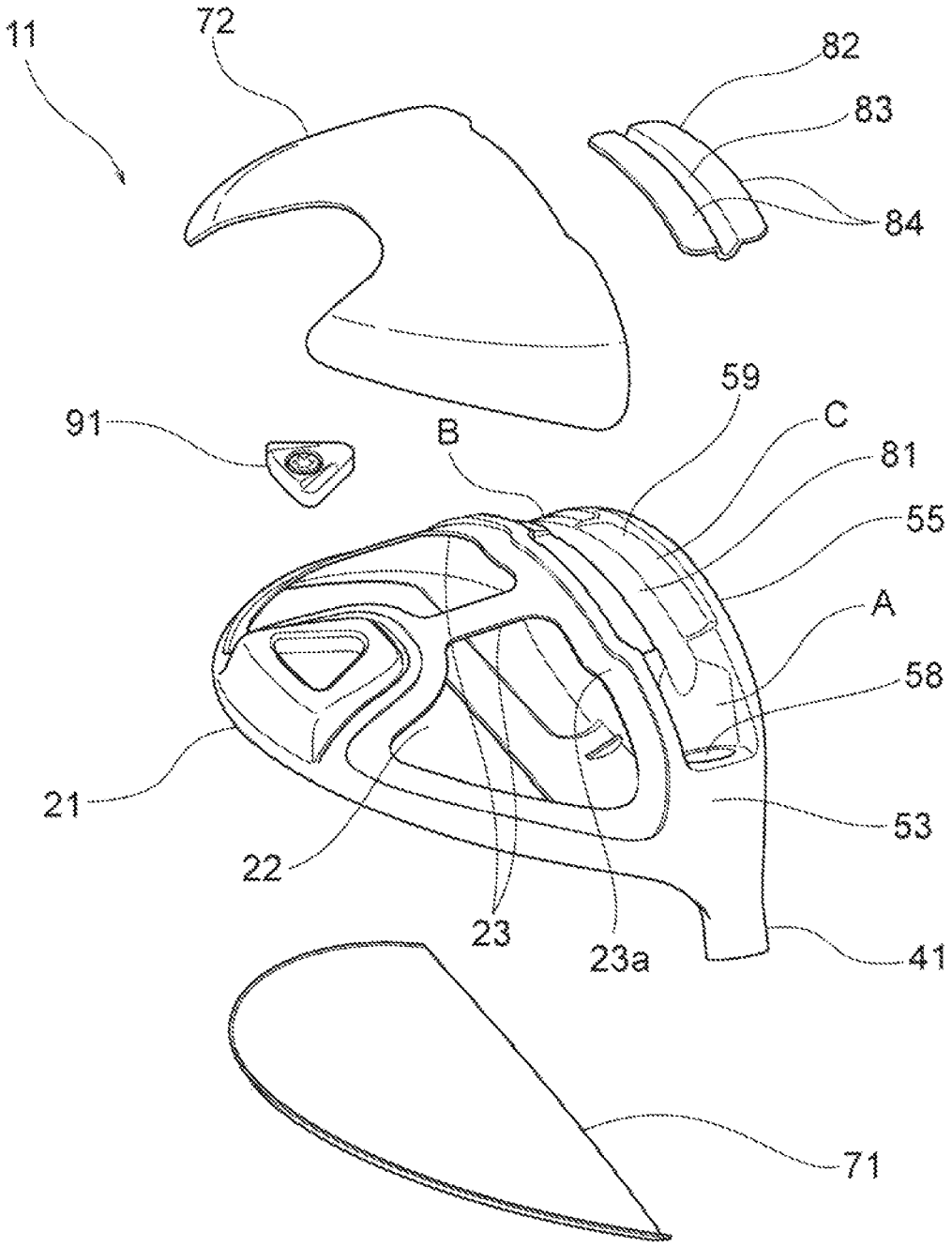
FIG. 5 is an exploded perspective view of the golf club head as viewed from the sole side.
Figure 6:
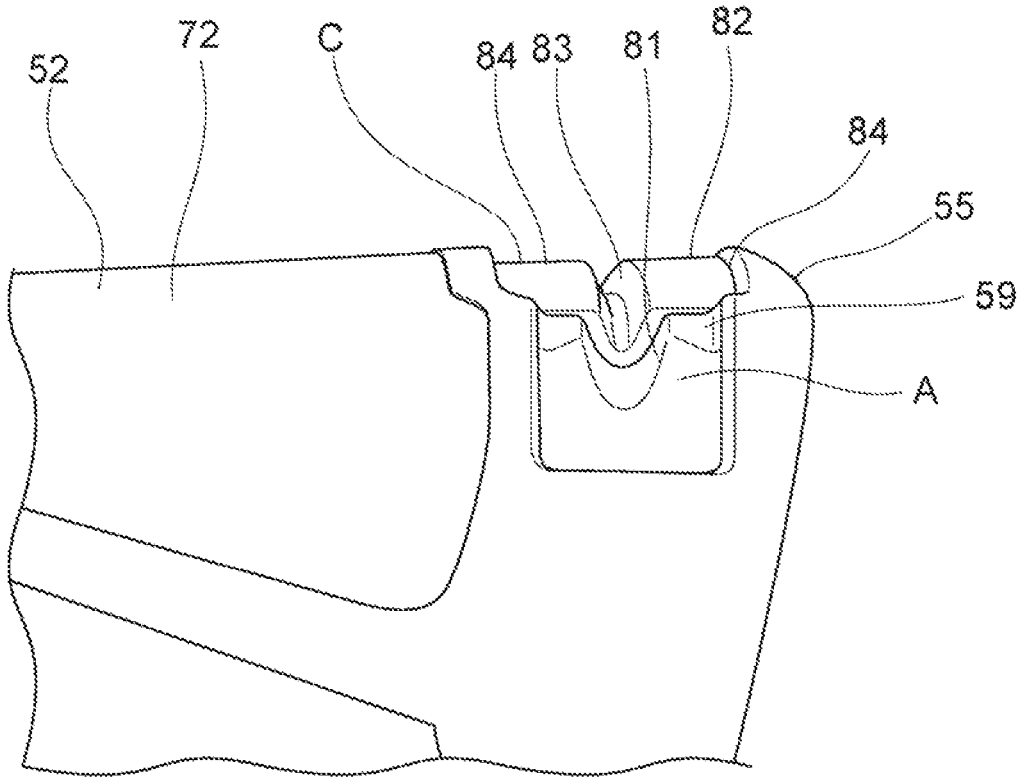
FIG. 6 is a perspective view of a slot and a reinforcing member.
Figure 7:
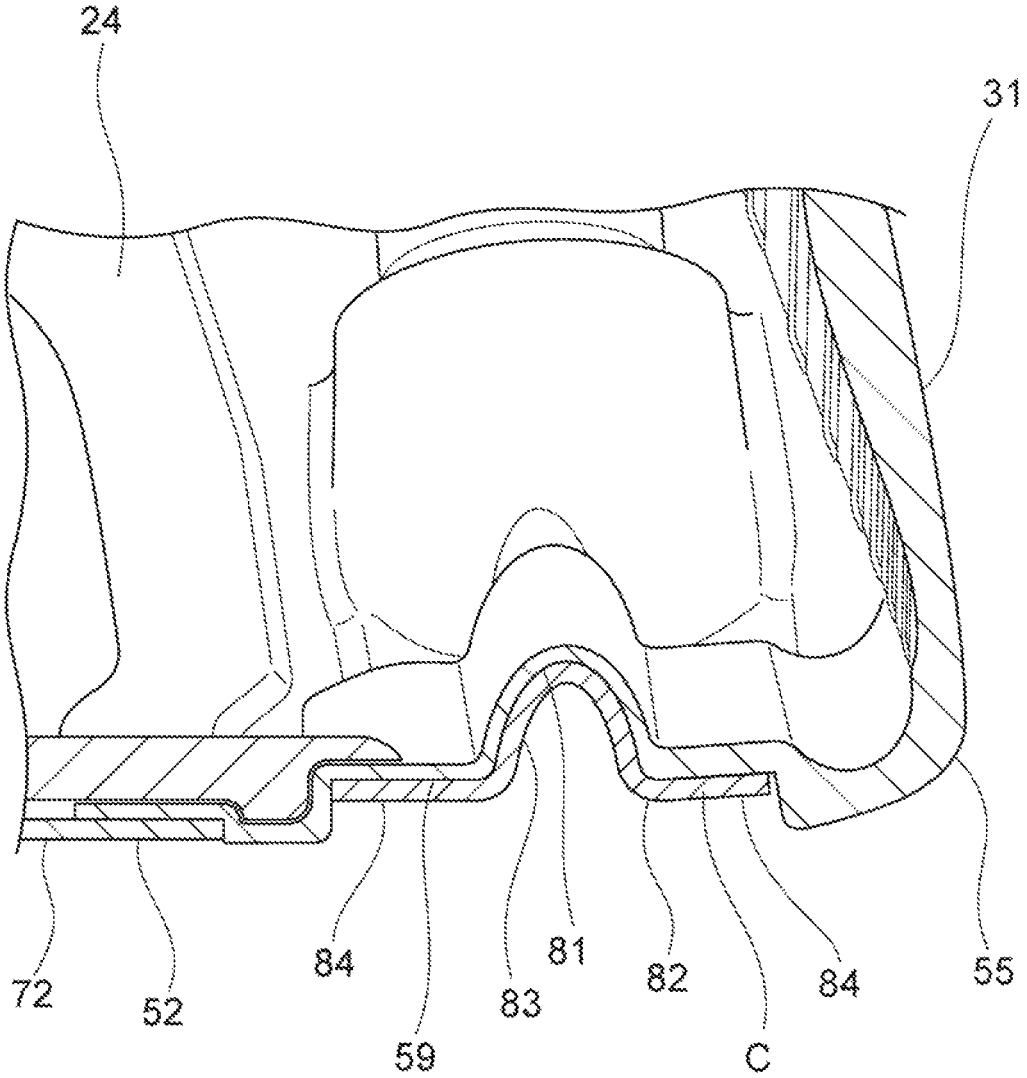
FIG. 7 is a cross-sectional view of the slot and the reinforcing member as viewed from the inside of the shell member.
Figure 8:
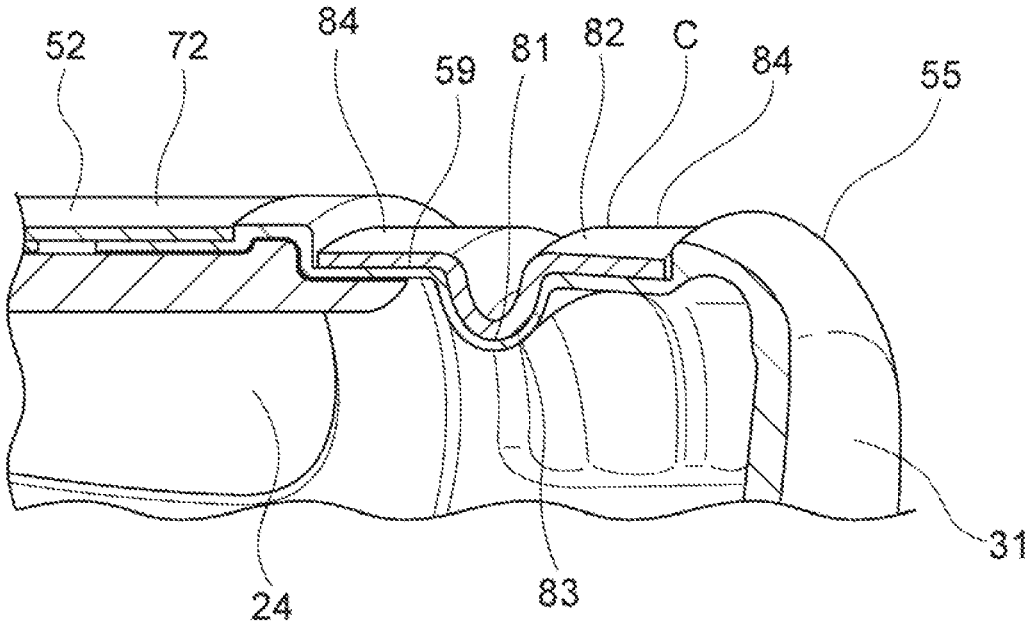
FIG. 8 is a cross-sectional view of the slot and the reinforcing member as viewed from the outside of the shell member.

As illustrated in FIGS. 3 to 5, the head shell 21 of this embodiment is provided with an upper opening 22 in the crown 51 and lower openings 23 in the sole 52. The lower openings 23 are divided into the heel 53 side and the toe 54 side. An interior space 24 of the head shell 21 is empty to allow visibility through the upper opening 22 and the lower openings 23.

In FIG. 5, the crown member 71 illustrated in a state separated from the upper opening 22 is fixed to the head shell 21 to close the upper opening 22, thereby forming the crown 51. The sole member 72 illustrated in a state separated from the lower openings 23 is fixed to the head shell 21 to close the lower openings 23, thereby forming the sole 52. The crown member 71 and the sole member 72 are made of a material containing carbon fiber reinforced plastic and close the empty interior space 24.

In FIG. 5, reference numeral 91 denotes a balance load weight that is attached rearward of the sole 52. The weight 91 can be detachably attached by a bolt to an attaching portion provided rearward of the sole 52, and by changing the weight, it is possible to make the balance load variable.

As illustrated in FIG. 3, the head shell 21 includes a stepped portion 22*a* around the upper opening 22. The stepped portion 22*a* is a region that is one-step lower. The stepped portion 22*a* has a shape fittable to the crown member 71 so that when the crown member 71 is fitted to the stepped portion 22*a*, the stepped portion 22*a* allows an upper surface of the crown member 71 and the head shell 21 to be connected without a level difference therebetween. The head shell 21 and the crown member 71 are bonded and fixed together by, for example, an adhesive.

As illustrated in FIGS. 4 and 5, the head shell 21 includes a stepped portion 23*a* around the lower openings 23. The stepped portion 23*a* is a region that is one-step lower. The stepped portion 23*a* has a shape fittable to the sole member 72 so that when the sole member 72 is fitted to the stepped portion 23*a*, the stepped portion 23*a* allows a lower surface of the sole member 72 and the head shell 21 to be connected without a level difference therebetween. The head shell 21 and the sole member 72 are bonded and fixed together by, for example, an adhesive.

The head shell 21 has a leading edge 55 in a region between the face 31 and the sole 52 (see FIG. 2). Inside the head shell 21, in the vicinity of the leading edge 55, a first boss 56 for shaft is provided on the heel 53 side, and a second boss 57 for weight attaching is provided on the toe 54 side (see FIG. 3).

A shaft hole 58 for inserting the shaft (not illustrated) passes through the first boss 56. The shaft hole 58 passes through to the sole 52 so as to support the shaft attaching/detaching work from the sole 52 side.

The second boss 57 is provided with a bolt hole (not illustrated) exposed to the sole 52. A toe weight 92 to be attached to the toe 54 side is fixedly screwed into this bolt hole.

(2) Slot and Reinforcing Member

The club head 11 of this embodiment has a concave slot 81 provided to the sole 52, and a reinforcing member 82 is fixed to the slot 81 by an adhesive.

The slot 81 is provided along the leading edge 55 (see FIG. 2) and has a groove shape elongated in the direction connecting the heel 53 and the toe 54. Inside the head shell 21, the slot 81 is disposed to extend between the two bosses 56, 57 (see FIGS. 3 and 4).

The sole 52 of the head shell 21 is formed with a recess 59 along the leading edge 55. The recess 59 provides a passing-through region A for the shaft hole 58 on the heel 53 side and provides an attaching region B for attaching the toe weight 92 on the toe 54 side. The slot 81 is disposed in a disposition region C connecting the passing-through region A on the heel 53 side and the attaching region B on the toe 54 side. The disposition region C is formed shallower than the passing-through region A and the attaching region B and formed wider than the passing-through region A and the attaching region B in the target direction TD (see FIGS. 2 and 4). The slot 81 disposed in the disposition region C has a cross-sectional shape forming a parabola.

The reinforcing member 82 is a plate-like member with its middle portion fitted to the slot 81 and with its both side portions fitted to the recess 59 and has a shape elongated in the direction connecting the heel 53 and the toe 54 (see FIGS. 2 and 4 to 8). For convenience of description, the portion fitted to the slot 81 is called a bent portion 83, and the portions fitted to the recess 59 are called both side portions 84. The reinforcing member 82 is made of fiber reinforced plastic formed using carbon fiber resin, metal fiber resin, or the like as a material. For example, the reinforcing member 82 can be obtained by impregnating thermosetting resin into a material formed by aligning or weaving carbon fibers or metal fibers, and then shaping it to be fittable to the slot 81 and the recess 59.

The slot 81 is formed thinner than the other portions of the head shell 21. The thickness of the slot 81 is, for example, 0.8 mm to 1.3 mm.

The thickness of the reinforcing member 82 is determined by its ratio to the groove width (the groove width in the target direction TD) of the slot 81. As a specific numerical value, the thickness of the reinforcing member 82 is set to about 10% to 20% of the groove width of the slot 81. For example, assuming that the groove width of the slot 81 is 7 mm to 8 mm, the thickness of the reinforcing member 82 is determined to be about 0.8 mm to 1.5 mm.

2. Actions

The golf club head of this embodiment acts as follows.

(1) Improvement in Restitution Performance

The club head 11 of this embodiment improves the restitution performance to a golf ball and contributes to an increase in flight distance.

The improvement in restitution performance is obtained by providing the slot 81. Upon hitting the ball with the face 31, the slot 81 bends in the target direction TD to generate the trampoline effect on the face 31, thereby contributing to enhancing the restitution performance.

The spring action of the reinforcing member 82 also contributes to the improvement in restitution performance. When the slot 81 bends in the target direction TD, the reinforcing member 82 also bends in the target direction TD, and the spring action occurs by its restoring force. This spring action helps to improve the restitution performance. The spring action of the reinforcing member 82 described above occurs effectively by setting the thickness of the reinforcing member 82 to about 10% to 20% of the groove width (the groove width in the target direction TD) of the slot 81.

(2) Compliance with SLE Rule

With respect to the coefficient of restitution (COR) of a golf club head, the SLE rule is regulated by the Royal and Ancient Golf Club of Saint Andrews (R & A) and the United States Golf Association (USGA). The COR is required to be within 0.830 obtained by adding a tolerance of 0.008 to 0.822.

On the other hand, in order to perform a COR test, it is necessary to use a designated ball and to measure the ratio of speeds of the ball before and after impact with a club head so that high accuracy is required at the time of the test. It takes time and effort to precisely measure all, and further, there is no 100% reproducibility. In view of this, a CT test was created. For a characteristic time (CT) value, it is possible to easily and accurately obtain a measured value based on a grounding time when a pendulum is dropped on a face. The limit of the CT value is 239 μs. Products within 257 μs obtained by adding a tolerance of 18 μs to 239 μs are determined to be the SLE rule compliant products.

In the product development, it is orthodox to establish a structure that increases the initial speed considered to be equated with the COR, and to employ a process to perform an adjustment while increasing the CT value as finishing. When applied to this embodiment, although roughly, the thinning by providing the slot 81 to the sole 52 corresponds to the establishment of the structure that increases the initial speed, and the thinning and the thickness adjustment of the slot 81 correspond to the process to perform the adjustment while increasing the CT value. In this event, as the thickness of the slot 81 decreases, the trampoline effect increases so that the initial speed and the CT value also increase.

Naturally, when the thickness of the slot 81 is made too thin, the strength is reduced, leading to damage. The lower limit value of the thickness that does not lead to damage is 0.8 mm. This is the critical significance of 0.8 mm.

On the other hand, when the thickness of the slot 81 exceeds 1.3 mm, the increasing action of the initial speed is weakened. The thickness of the slot 81 is desirably 1.3 mm or less. This is the critical significance of 1.3 mm.

However, if it is questioned whether the thickness of the slot 81 is always desired to be 0.8 mm, it cannot be said so. This is because there are cases where the CT value exceeds the upper limit target of 239 μs.

In this regard, according to this embodiment, while the thinning of the slot 81 acts in the direction to increase the initial speed (COR) and the CT value, the reinforcing member 82 acts in the direction to suppress the increase in CT value and does not largely affect the COR. That is, the configuration of bonding the reinforcing member 82 to the slot 81 makes it possible to increase the initial speed (COR) while suppressing the increase in CT value so as to make the CT value compliant with the SLE rule.

More specifically, the initial speed (COR) increases and the CT value also increases by thinning the slot 81. In this event, since the reinforcing member 82 suppresses the increase in CT value, further thinning of the slot 81 is made possible compared to the case where the reinforcing member 82 is not provided. Correspondingly, the initial speed can also be increased. A concern here may be whether the COR exceeds the target value of 0.822. However, there is no such a possibility. This is because while the COR also increases by the thinning of the slot 81, its increasing rate is not so high as that of the CT value.

As described above, with the club head 11 of this embodiment, it is possible to improve the initial speed performance while suppressing the increase in CT value so as to make the CT value compliant with the SLE rule, thereby achieving a further increase in flight distance.

(3) Improvement in Strength of Slot

The strength of the slot 81 can be reinforced by bonding the reinforcing member 82 made of the fiber reinforced plastic. As a result, it is possible to maintain the durability even when the slot 81 is thinned.

The improvement in the strength of the slot 81 can also be realized by forming the slot 81 in a cross-sectional shape forming a parabola, i.e., in a curved surface shape with no corners. This is because since a crack occurs in the slot 81 from a corner portion, it is possible to make a crack less prone to occur by eliminating the corner.

(4) Shock Damping Action

It is possible to obtain a shock damping action by bonding the reinforcing member 82 made of the fiber reinforced plastic in the slot 81. Consequently, the load to the face 31 upon hitting a ball is reduced, and therefore, the reduction in the thickness of the face 31 is made possible also from this aspect.

Further, the shock damping action by the reinforcing member 82 also generates an effect to stabilize the behavior of the club head 11. This is because when the hitting point deviates from the sweet spot on the face 31, the behavior of the club head 11 becomes unstable, but with the shock damping action, the degree of unstableness is relaxed. As a result, it is possible to stabilize the launch performance (launch angle, spin rate) of the ball.

(5) Club Performance Adjustment Function

By changing the thickness of the reinforcing member 82 in the range where the spring action occurs, the bending amount of the slot 81 changes so that it is possible to adjust the club performance. By adjusting the club performance to match the head speed of an individual player, it is possible to adjust the launch performance (launch angle, spin rate) to match a player with a specific head speed so that it is possible to provide a range of club selection optimal to an individual person.

(6) Fixing Strength of Reinforcing Member

The reinforcing member 82 is bonded and fixed in such a way as to extend even to the recess 59. This makes it possible to increase the fixing strength of the reinforcing member 82.

3. Modifications

When implementing the embodiment described above, various changes or modifications can be made.

For example, in the above-described embodiment, the configuration example in which the slot 81 is provided in the recess 59 is given by way of example, but the recess 59 is not necessarily required. The slot 81 may be provided directly on the surface of the sole 52.

Regardless of whether or not the recess 59 is provided, it is satisfactory for the reinforcing member 82 to be bonded in the slot 81, and therefore, the both side portions 84 are not necessarily essential.

The above-described numerical values of the thicknesses of the slot 81 and the reinforcing member 82, and so on are by way of example only, and these numerical value ranges do not constitute any limitation.

Besides, any changes or modifications are allowed.

What is claimed is:

1. A golf club head comprising:

a head shell made of metal;

a face provided to the head shell;

a sole provided to the head shell to be continuous with the face through a leading edge;

a groove having a bottom that defines a slot having a concave shape in cross section forming a parabola and provided to the sole along the leading edge, the slot configured to bend in a target direction upon hitting a ball with the face; and a reinforcing member made of fiber reinforced plastic and bonded in the slot, the reinforcing member configured to apply a resistance to bending of the slot.

2. The golf club head according to claim 1, wherein the slot has a groove shape that is elongated in a direction connecting a heel and a toe.

3. The golf club head according to claim 2, wherein the reinforcing member has a shape elongated in the direction connecting the heel and the toe.

4. The golf club head according to claim 3, wherein the reinforcing member has a concave shape in cross section along the cross-sectional shape of the slot.

5. The golf club head according to claim 4, wherein:

the sole has a recess provided along the leading edge, the slot disposed in the recess; and the reinforcing member is provided to extend even to the recess.

6. The golf club head according to claim 4, wherein a thickness of the reinforcing member is 10% to 20% of a width of the slot in the target direction.

7. The golf club head according to claim 3, wherein a thickness of the slot is 0.8 mm to 1.3 mm.

8. The golf club head according to claim 3, wherein a thickness of the reinforcing member is 10% to 20% of a width of the slot in the target direction.

9. The golf club head according to claim 2, wherein a thickness of the slot is 0.8 mm to 1.3 mm.

10. The golf club head according to claim 2, wherein a thickness of the reinforcing member is 10% to 20% of a width of the slot in the target direction.

11. The golf club head according to claim 1, wherein the sole has a recess provided along the leading edge, the slot disposed in the recess.

12. The golf club head according to claim 11, wherein the reinforcing member is provided to extend even to the recess.

13. The golf club head according to claim 1, wherein a thickness of the slot is 0.8 mm to 1.3 mm.

14. The golf club head according to claim 1, wherein a thickness of the reinforcing member is 10% to 20% of a width of the slot in the target direction.

* * * * *